US007270169B2

(12) United States Patent
Ergin et al.

(10) Patent No.: US 7,270,169 B2
(45) Date of Patent: Sep. 18, 2007

(54) METHOD AND APPARATUS FOR POURING SEVERAL MOULDS IN A MOULD-STRING PLANT IN ONE POURING OPERATION

(75) Inventors: Huseyin Erol Ergin, Naperville, IL (US); Henning Rahlf Nielsen, Ballerup (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 10/547,747

(22) PCT Filed: Dec. 11, 2003

(86) PCT No.: PCT/DK03/00852

§ 371 (c)(1),
(2), (4) Date: Sep. 29, 2006

(87) PCT Pub. No.: WO2005/056214

PCT Pub. Date: Jun. 23, 2005

(65) Prior Publication Data

US 2007/0074843 A1 Apr. 5, 2007

(51) Int. Cl.
*B22C 11/10* (2006.01)
*B22D 47/02* (2006.01)

(52) U.S. Cl. ..... 164/130; 164/136; 164/137; 164/323; 164/337

(58) Field of Classification Search ..... 164/130, 164/136, 137, 323, 337
See application file for complete search history.

(56) References Cited

U.S. PATENT DOCUMENTS 4,538,665 A * 9/1985 Uzaki et al. ..... 164/160.1
5,735,334 A * 4/1998 Sutton et al. ..... 164/130
6,463,993 B1 * 10/2002 Cle Nogueras et al. ..... 164/322
6,668,904 B1 * 12/2003 Johansen ..... 164/7.1

FOREIGN PATENT DOCUMENTS

| | | |
|---|---|---|
| JP | 59 220247 | 12/1984 |
| JP | 04 105751 | 4/1992 |
| WO | WO 02/26427 | 4/2002 |

* cited by examiner

*Primary Examiner*—Kevin Kerns
*Assistant Examiner*—I.-H. Lin
(74) *Attorney, Agent, or Firm*—Stites & Harbison PLLC; Douglas E. Jackson

(57) ABSTRACT

In a method for pouring several moulds in a mould-string plant in the pouring operation, the moulds are produced by compression of sand or similar mould material in a pressing chamber comprising pattern plates 3, 4 for providing impressions in the surfaces of the mould parts for forming the mould cavities 11 and inlet runners 8. The moulds are advanced to a pouring track or guideway, on which the casting moulds are formed by positioning the mould parts close together and the advancement of the casting moulds is stepwise through a pouring station, in which the moulds are filled with molten metal. By providing at least one runner 7 for mutually connecting at least two inlet runners 8 for consecutive mould cavities 11, the mutually connected mould cavities can be filled through a single pouring inlet 8, and unused pouring inlets 8 may be plugged by a suitable plug 14 in order to minimise the amount of molten metal needed to fill the mould cavities 11.

8 Claims, 4 Drawing Sheets

METHOD AND APPARATUS FOR POURING SEVERAL MOULDS IN A MOULD-STRING PLANT IN ONE POURING OPERATION

CROSS-REFERENCE TO RELATED APPLICATION

This application is a 371 of PCT/DK03/00852 filed on Dec. 11, 2003.

TECHNICAL FIELD

The present invention relates to a method and an apparatus for pouring molten metal into moulds in a mould-string foundry plant.

BACKGROUND ART

In mould-string foundry plants of this kind it is known to produce the moulds one at a time in the mould-making stations and deliver the produced moulds to a precision conveyor, advancing the moulds stepwise to a pouring station, in closely juxtaposed position forming a mould string with casting cavities at the mainly vertical parting surfaces between successive moulds. Each step in the stepwise advancement of the mould string corresponds to the length occupied by one mould and the mould cavities are filled with molten metal one at a time in the pouring station. The advancing of the moulds is partly performed by the mould-making station pushing a produced mould against the mould string, partly by advancing the precision conveyor, on which the mould string is positioned. The time available for the pouring is the standstill period for the stepwise advancement of the mould string, said standstill period being closely related to the production time for the mould-making machine. In order to increase the time for pouring the moulds, it has been suggested, e.g. in WO 02/26427, to keep the mould string stationary for the time used for producing two moulds in the mould-making station, and having each step in the stepwise advancement of the mould string correspond to the length occupied by two moulds. In this connection the pouring station has been indicated to comprise two pouring outlets for filling two consecutive mould cavities in the mould string.

DISCLOSURE OF THE INVENTION

It is an object of the present invention to provide a method and an apparatus of the kind referred to above, with which it is possible to pour several moulds in a mould-string plant in one pouring operation, only using a single pouring outlet in the pouring station, and at the same time providing a possibility of increasing the yield of the foundry plant, and this object is achieved with a method of said kind, and an apparatus for performing the method, With this arrangement, several moulds are filled through one inlet opening, thus simplifying the pouring station arrangement and at the same time, the time available for the pouring corresponds to the increased stop time for the intermittent advancement of the mould string, i.e. the time used for producing a number of moulds corresponding to the number of moulds filled at the same time.

Preferred embodiments of the method and the apparatus, e.g. comprising the insertion of plugs in unused filling openings and different ways of separating the mould cavities to be filled at one time from other mould cavities, are revealed in the subordinate claims.

BRIEF DESCRIPTION OF THE DRAWINGS

In the following detailed part of the present description, the invention will be explained in more detail with reference to the exemplary embodiment of a method and an apparatus for pouring several moulds in a mould-string plant in one pouring operation according to the invention shown in the drawings, in which FIG. 1*a* and 1*b* schematically show a set of pressure plates for use in a mould-making station in accordance with the present invention, FIG. 2 schematically shows a mould string produced in a mould-making station by means of the pressure plates shown in FIGS. 1*a* and 1*b*, FIG. 3 schematically shows a mould string produced in an alternative way with plugs.

DESCRIPTION OF THE PREFERRED EMBODIMENTS

Figure 1B:
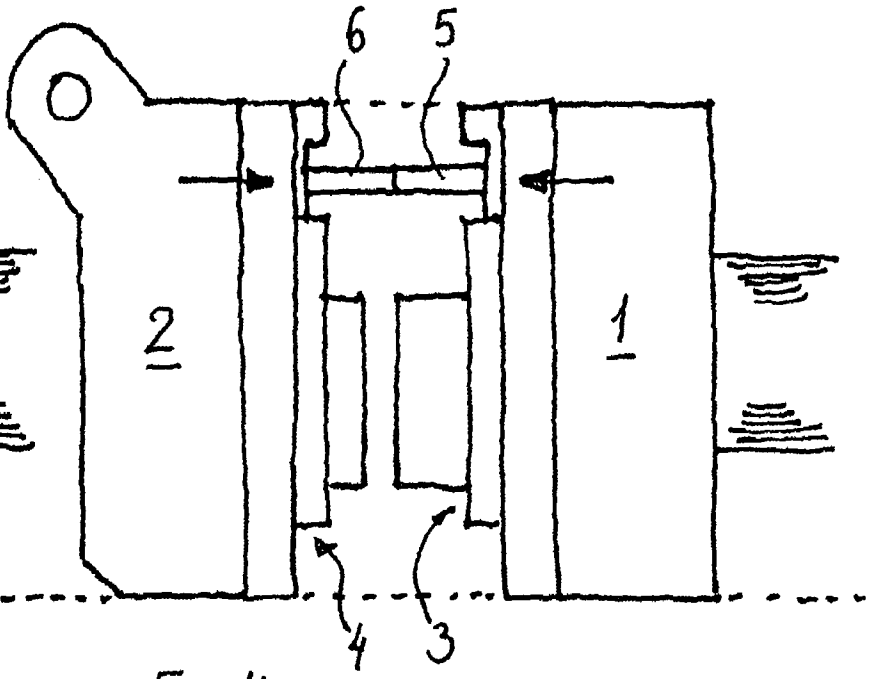
Figure 1A:
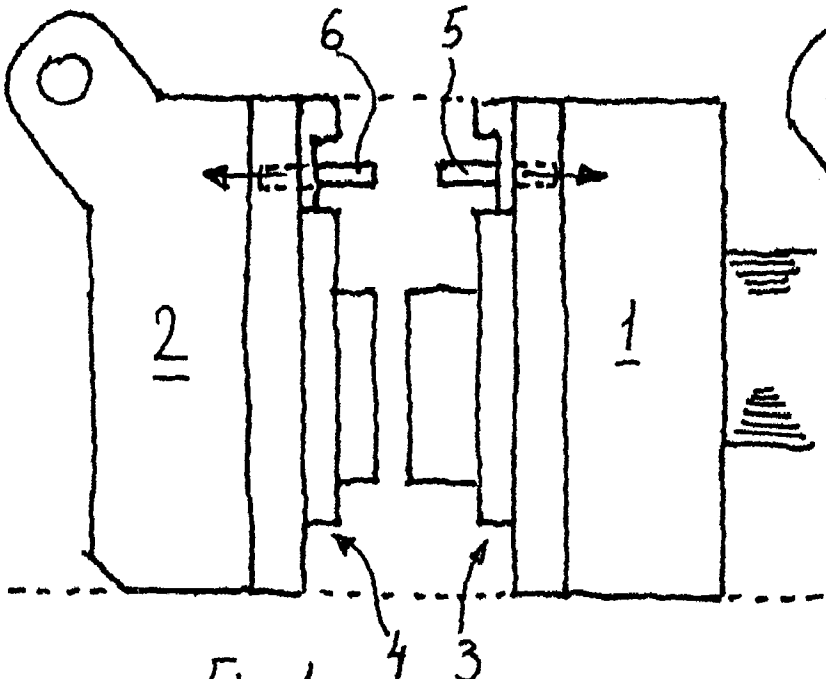

Referring to FIG. 1*a* and FIG. 1*b*, these figures show the squeeze plates for a mould-making station, in which moulds are formed by compressing sand in a squeeze chamber and subsequently expelled from the chamber and moved into intimate contact with a string of corresponding moulds previously produced, whereby a mould chamber is provided between successive moulds at the mainly vertical parting surface between such moulds. The squeeze plates comprise a squeeze plate 1 and a swingable squeeze plate 2 and the squeeze plate 1 is provided with a pattern plate 3 and the swingable squeeze plate 2 is provided with a pattern plate 4. In order to make it possible to expel the produced moulds in a simple manner, the swingable squeeze plate 2 is made swingable to move it out of the way for expelling the produced mould, as shown in FIG. 2.

The pattern plate 3 on the squeeze plate 1 is provided with a pattern element 5 and correspondingly the pattern plate 4 on the swingable squeeze plate 2 is provided with a pattern element 6, said pattern elements 5, 6 being positioned and formed to form a horizontal runner 7 in the produced moulds. As indicated in FIGS. 1*a* and 1*b* by means of the arrows, the pattern elements 5, 6 are movable in a horizontal direction, whereby some of the moulds can be provided with the horizontal runner 7 extending all the way through the mould and other moulds are provided with this horizontal runner 7 only extending part of the way through the mould as shown in FIG. 2. In the position of the pattern elements 5, 6 shown in FIG. 1*a*, a disconnection between horizontal runners is provided by the sand present between the two pattern elements 5, 6, and in the position of the pattern elements 5, 6 shown in FIG. 1*b*, the horizontal runner 7 is provided between the mould cavities on opposite sides of the mould part produced. In FIG. 2 the mould string is shown, in which every second mould is produced with the pattern elements 5, 6 in the position shown in FIG. 1*a* and every second mould is produced with the pattern elements 5, 6 in the position shown in FIG. 1*b*. This provides a string of moulds, in which the mould cavities 11 are connected in pairs. In this way, two consecutive mould cavities can be filled through one pouring inlet 8.

In order to minimise the amount of molten metal to be used for filling the mould cavities, the unused pouring inlets 8 may be plugged by suitable plugs 14.

Figure 2:
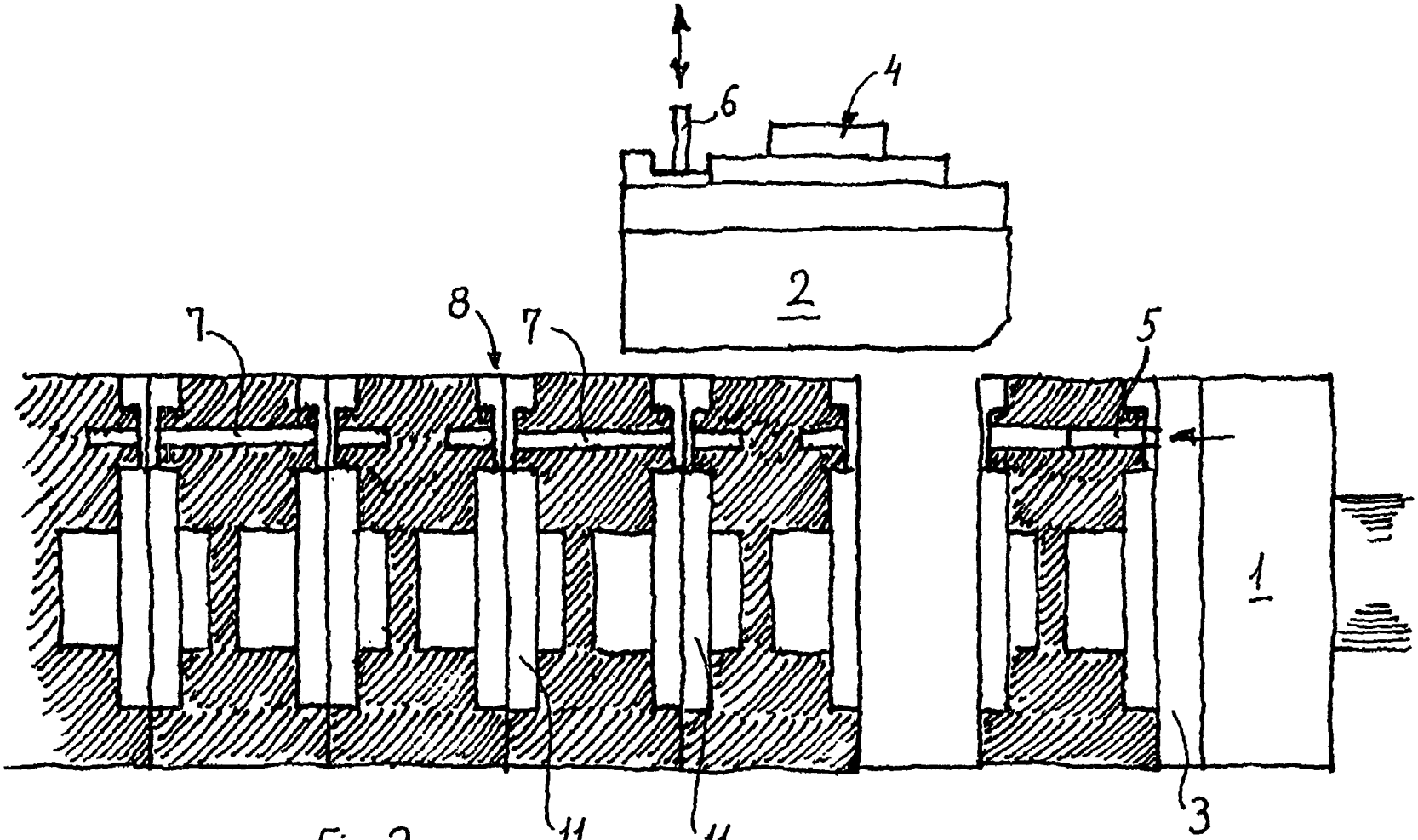

In FIG. 2 the mould string comprises mould cavities, in which these are mutually connected by the horizontal runner 7 in pairs, but it will be evident that more than two mould cavities 11 may be connected by the horizontal runner 7, whereby several mould cavities 11 may be filled with molten metal through one single pouring inlet 8 and the non-used pouring inlets 8 can be plugged with suitable plugs 14, whereby the amount of molten metal for pouring the moulds can be minimised.

Figure 3:
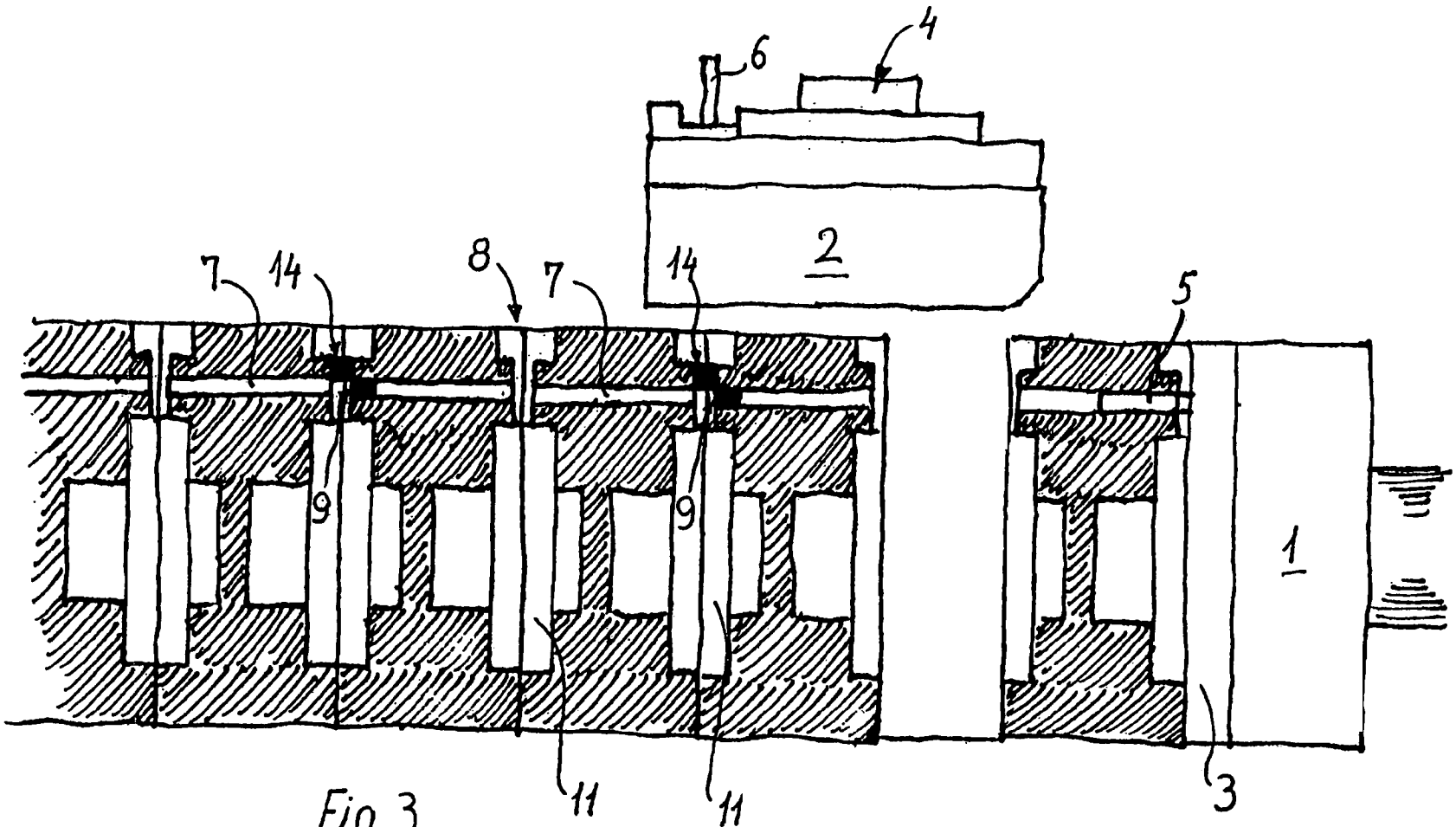

In an alternative embodiment shown in FIG. 3, the horizontal runner 7 is provided through all the moulds produced in the mould-making station and the separation of a number of moulds to be poured through a single pouring inlet may be provided by inserting a suitable plug 9 in the horizontal runner immediately after the production thereof in the mould-making station. Preferably, this plug 9 is inserted in combination with the insertion of a core in the mould cavity 11 if such a core is needed in order to produce the desired moulded parts.

In the FIGS. 4-8*b*, different constructions of the pattern elements 5, 6 for forming the horizontal runner 7 are shown.

Figure 4:
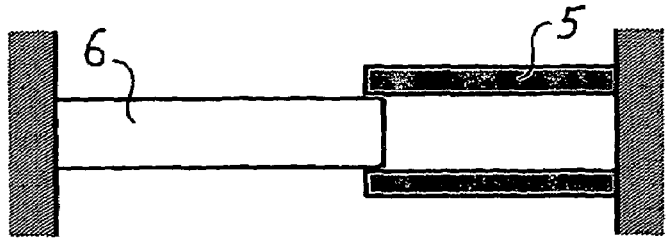
FIGS. 4-8*b* show different constructions of the runner pattern elements for forming a horizontal runner connection between inlet runners for consecutive mould cavities in accordance with preferred embodiments of the present invention.

FIG. 4 shows a fixed pattern element 6, which is slidably positioned in a corresponding pattern element 5, said sliding movement being necessary in order to make it possible to move the squeeze plates relative to one another for squeezing the mould material between the pattern plates 3, 4.

Figure 5:
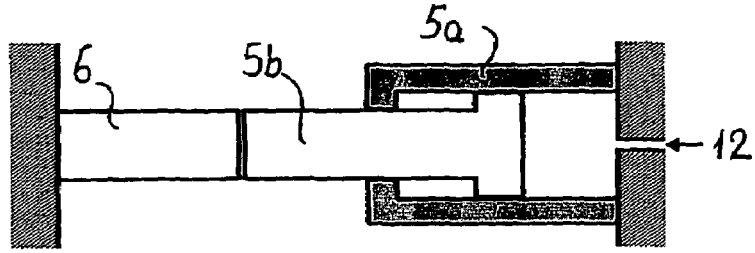

In FIG. 5, the pattern element 6 is again a fixed element and the corresponding pattern element 5 is provided in the form of a movable element 5*b* and a fixed cylinder 5*a*, in which the movable pattern element 5*b* is mounted for axial movement. In order to be able to control the position of the movable pattern element 5*b*, the cylinder element 5*a* is provided with an inlet 12, which may be connected to a hydraulic or pneumatic supply in order to press the movable pattern element 5*b* towards the fixed pattern element 6. Thus, the movable pattern element 5*b* is moving like a piston inside this fixed cylinder-formed pattern element 5*a*.

Figure 6:
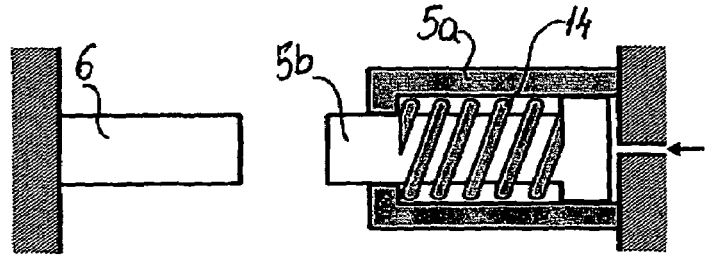

FIG. 6 shows an alternative to FIG. 5, in which the movable pattern element 5*b* is pressed into its retracted position by a spring 15 and movable by hydraulic or pneumatic pressure supplied through an inlet 12.

Figure 7:
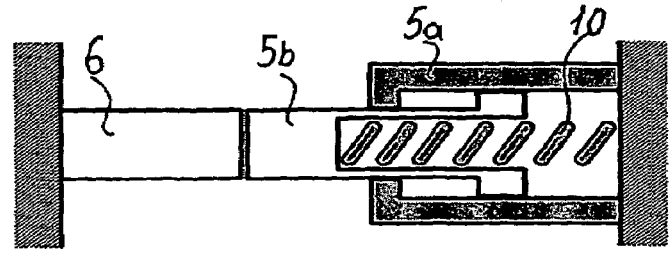

FIG. 7 corresponds more or less to FIGS. 5 and 6 and comprises a fixed pattern element 6, a cylinder-formed pattern element 5*a* and a piston-like movable pattern element 5*b*. In the construction in accordance with FIG. 7, the movable pattern element 5*b* is pressed towards the fixed pattern element 6 by means of a spring 10.

Figure 8A:
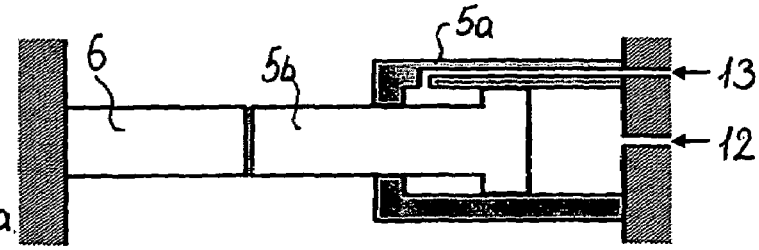
Figure 8B:
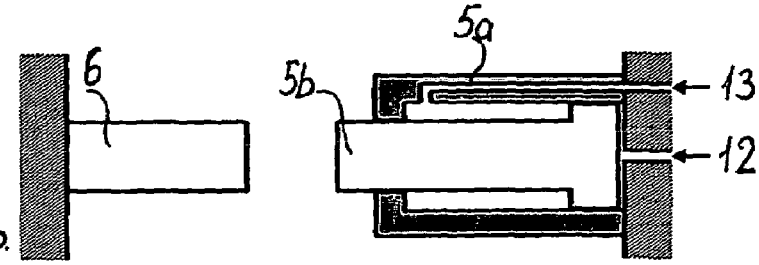

The pattern elements 5, 6 shown in FIGS. 8*a* and 8*b* are intended to provide the function corresponding to the above description of FIGS. 1*a*, 1*b* and 2. Again, this construction comprises a fixed pattern element 6 and a movable piston-like pattern element 5*b* mounted to be movable in a fixed cylinder-like pattern element 5*a*. In the position shown in FIG. 8*a*, hydraulic or pneumatic pressure is provided at an inlet 12 in order to move the movable pattern element 5*b* towards the fixed pattern element 6. The hydraulic or pneumatic pressure supplied to the inlet 12 will be sufficient to keep the movable cylinder-like pattern element 5*a* in contact with the fixed pattern element 6 but will also allow a certain movement of the movable pattern element 5*b* in the cylinder-formed fixed pattern element 5*a* in order to allow the squeezing movement of the squeeze plates 1, 2.

In the position shown in FIG. 8*b*, a hydraulic or pneumatic pressure is supplied to the inlet 13, whereby the movable pattern element 5*b* is retracted to the position shown, whereby no contact is present between the fixed pattern element 6 and the movable pattern element 5*b*. In this way, sand will be present between these two pattern elements and no horizontal runner connection 7 will be provided in the mould produced.

In the foregoing, the pattern elements 5, 6 have been described with one of these pattern elements 5 being possibly retractable in a axial direction corresponding to the squeezing direction for the squeeze plates, however, other types of movement of one of the pattern elements 5, 6 could be envisaged, such as a swingable mounting of the movable pattern element 5, whereby the contact between the fixed pattern element 6 and the swingable pattern element 5 will not be provided in one position for the swingable pattern element 5 and will be provided in another position of the swingable pattern element 5.

Advantageously, the mould string produced in accordance with the present invention is moved stepwise over a length corresponding to the number of mutually connected mould cavities multiplied by the thickness of each mould part in the movement direction, as this will have the advantage of having the pouring inlet 8 in a fixed position during an extended period of time for filling the mutually connected mould cavities with molten metal. With a high production rate in the mould-making station, the step size and accordingly the number of mutually connected mould cavities 11 may be sufficiently long to allow a sufficient long time for pouring the moulds.

In the above description the invention has been described in connection with preferred embodiments thereof, however, it will be evident for a man skilled in the art that the basic concept of the present invention, as reflected in the appended claims, may be used in many ways, such as e.g. in connection with counter-gravity pouring, where the pouring inlet 8 will be positioned on the side of the mould string or at the bottom thereof and correspondingly the horizontal runner 7 will be provided close to the bottom of the mould cavities 11. Furthermore, a non-horizontal runner connection 7 may be provided between the inlet runners 8 for consecutive mould cavities 11.

The invention claimed is:

1. A mould-making apparatus for a mould-string foundry plant, said apparatus comprising a pressure chamber for producing mould parts by compressing sand or similar mould material, said chamber comprising movable pattern plates for forming impressions in the surfaces of the mould parts, whereby mould cavities are provided at the interface between the mould parts, when these are positioned in close proximity, a pouring track or guideway to receive the produced mould parts and stepwise advancing the string of moulds, a pouring station, in which the mould cavities are filled with molten metal, said pattern plates comprising runner pattern elements for forming a runner connection between inlet runners for consecutive mould cavities, characterized by further comprising means selectively retracting or otherwise moving at least one of the pattern elements for forming the runner connection, whereby no connection is formed when this pattern element is retracted or moved from its normal position.

2. A apparatus in accordance with claim 1, characterized by the pattern elements for forming the runner connection comprising a flexibility in the compression direction, in order the allow the relative movement between the two pattern plates.

3. A apparatus in accordance with claim 1, characterized by further comprising a plug insertion device for selectively inserting a plug in an inlet opening of the unused upper parts of the inlet runners of the mould cavities, which are filled from neighbouring inlet openings.

4. A method for pouring moulds in a mould-string plant in accordance with claim 1 comprising the steps of:

producing mould parts by the compression of sand or similar mould material in a pressing chamber, said pressing chamber comprising pattern plates for providing impressions in the surfaces of the mould parts for forming the mould cavities and inlet runners, feeding the produced mould parts from the pressing chamber to a pouring track or guideway, on which the casting mould is formed by positioning the mould parts close together, advancing the casting moulds stepwise through a pouring station, in which the moulds are filled with molten metal, providing at least one runner for mutally connection to at least two inlet runners for consecutive mould cavities, and filling the moulds connected by the runner through a single inlet opening, characterized by comprising the steps of:

providing the runner to mutally connect all the inlet runners in a number of consecutive moulds and retracting or moving at least one of the pattern elements for forming the runner connection after the production of a number of mould parts, thus limiting the number of mutually connected mould cavities to this number.

5. A method in accordance with claim 4, characterized by comprising the step of closing the unused inlet openings with plugs.

6. A method in accordance with claim 4, characterized by the advancing step comprising a stepwise advancement of the casting moulds with a step length corresponding to the number of mutually connected mould cavities multiplied by the thickness of each mould part in the movement direction.

7. A method in accordance with claim 4, characterized by the number of mutually connected mould cavities being equal to two.

8. A method in accordance with claim 1, characterized by further comprising the step of:

Inserting cores in the mould cavities, using specially designed cores selectively, comprising appropriate plugs for blocking the inlet openings, as required.

* * * * *